US006102983A

United States Patent [19]

Skaland

[11] Patent Number: 6,102,983

[45] Date of Patent: Aug. 15, 2000

[54] CAST IRON INOCULANT AND METHOD FOR PRODUCTION OF CAST IRON INOCULANT

[75] Inventor: Torbjørn Skaland, Kristiansand, Norway

[73] Assignee: Elkem ASA, Norway

[21] Appl. No.: 09/098,149

[22] Filed: Jun. 16, 1998

[30] Foreign Application Priority Data

Dec. 8, 1997 [NO] Norway ..... 975759

[51] Int. Cl.[7] ..... C21C 7/04; C22C 1/06

[52] U.S. Cl. ..... 75/568; 75/328; 420/33; 420/581; 420/578; 420/590

[58] Field of Search ..... 72/328, 568, 377, 72/232, 235, 255; 420/578, 581, 33, 590; 148/322

[56] References Cited

U.S. PATENT DOCUMENTS 3,527,597 9/1970 Dawson ..... 420/78

FOREIGN PATENT DOCUMENTS 95 24508 9/1995 WIPO .

OTHER PUBLICATIONS

*Sci.Bull.P.U.B.*, vol. 55, Nr.1–2, 1993, M. Chisamera et al.—"The Influence on the Morphology of the Graphite of S,O,Ti and A1 Inoculation after Mg–Treatment"—pp. 235–247 No Month.

*Primary Examiner*—Prince Willis
*Assistant Examiner*—Tima McGuthry-Banks
*Attorney, Agent, or Firm*—Bierman, Muserlian and Lucas

[57] ABSTRACT

The invention relates to an inoculant for the manufacture of cast iron with lamellar, compacted or spheroidal graphite. The inoculant comprises between 40 and 80% by weight of silicon, between 0.5 and 10% by weight of calcium and/or strontium and/or barium, between 0 and 10% by weight of cerium and/or lanthanum, between 0 and 5% by weight of magnesium, less than 5% by weight of aluminium, between 0 and 10% by weight of manganese and/or titanium and/or zirconium, between 0.5 and 10% by weight of oxygen in the form of one or more metal oxides, the balance being iron, said inoculant further comprising between 0,1 and 10% by weight of sulphur in the form of one or more metal sulphides. The invention further relates to a method for the production of the inoculant.

11 Claims, No Drawings

CAST IRON INOCULANT AND METHOD FOR PRODUCTION OF CAST IRON INOCULANT

TECHNICAL FIELD

The present invention relates to a ferrosilicon based inoculant for the manufacture of cast iron with lamellar, compacted or spheroidal graphite and to a method for production of the inoculant.

BACKGROUND ART

Cast iron is typically produced in cupola or induction fumaces, and generally contain between 2 to 4 per cent carbon. The carbon is intimately mixed with the iron and the form which the carbon takes in the solidified cast iron is very important to the characteristics and properties of the iron castings. If the carbon takes the form of iron carbide, then the cast iron is referred to as white cast iron and has the physical characteristics of being hard and brittle which in certain applications is undesirable. If the carbon takes the form of graphite, the cast iron is soft and machinable and is referred to as grey cast iron.

Graphite may occur in cast iron in the lamellar, compacted or spheroidal forms and variations thereof. The spheroidal form produces the highest strength and most ductile form of cast iron.

The form, size and number distribution the graphite takes as well as the amount of graphite versus iron carbide, can be controlled with certain additives that promote the formation of graphite during solidification of cast iron. These additives are referred to as inoculants and their addition to the cast iron as inoculation. In casting iron products from liquid cast iron, there will always be a risk for the formation of iron carbides in thin sections of castings. The formation of iron carbide is brought about by the rapid cooling of the thin sections as compared to the slower cooling of the thicker sections of the casting. The formation of iron carbide in a cast iron product is referred to in the trade as "chill". The formation of chill is quantified by measuring "chill dept" and the power of an inoculant to prevent chill and reduce chill depth is a convenient way in which to measure and compare the power of inoculants. in cast iron containing spheroidal graphite the power of inoculants is also commonly measured by the number density per unit area of spheroidal graphite particles is the as-cast condition. A higher number density per unit area of graphite spheroids means that the power of inoculation or graphite nucleation has been improved.

There is a constant need to find inoculants which reduce chill depth and improve the machinability of grey cast irons as well as increase the number density of graphite spheroids in ductile cast irons.

Since the exact chemistry and mechanism of inoculation and why inoculants function as they do is not completely understood, a great deal of research goes into providing the industry with a new inoculant.

It is thought that calcium and certain other elements suppress the formation of iron carbide and promote the formation of graphite. A majority of inoculants contain calcium. The addition of these iron carbide suppressants is usually facilitated by the addition of a ferrosilicon alloy and probably the most widely used ferrosilicon alloys are the high silicon alloy containing 70 to 80% silicon and the low silicon alloy containing 45 to 55% silicon.

U.S. Pat. No. 3,527,597 discovered that good inoculating power is obtained with the addition of between about 0.1 to 10% strontium to a silicon-bearing inoculant which contains less than about 0.35% calcium and up to 5% aluminium.

It is further known that if barium is used in conjunction with calcium the two act together to give a greater reduction in chill than an equivalent amount of calcium.

The suppression of carbide formation is associated by the nucleating properties of the inoculant. By nucleating properties it is understood the number of nuclei formed by an inoculant. A high number of nuclei formed improves the inoculation effectiveness and improves the carbide suppression. Further a high nucleation rate may also give better resistance to fading of the inoculating effect during prolonged holding time of the molten iron after inoculation.

From WO 95/24508 it is known a cast iron inoculant showing an increased nucleation rate. This inoculant is a ferrosilicon based inoculant containing calcium and/or strontium and/or barium, less than 4% aluminium and between 0.5 and 10% oxygen in the form of one or more metal oxides. Unfortunately it has been found that the reproducibility of the number of nucleis formed using the inoculant according to WO 95/24508 is rather low. In some instances a high number of nucleis are formed in the cast iron, but in other instances the number of nucleis formed are rather low. The inoculant according to WO 95/24508 has for the above reason found little use in practice.

DISCLOSURE OF INVENTION

It has now been found that the addition of sulphur in the form of one or more metal sulphides to the ferrosilicon based inoculant disclosed in WO 95/24508 surprisingly further increases the number of nucleis formed when adding the inoculant to cast iron and even more important gives a far better reproducibility with respect to formation of nucleis.

According to a first aspect the present invention relates to an inoculant for the manufacture of cast iron with lamellar, compacted or spheroidal graphite wherein said inoculant comprises between 40 and 80% by weight of silicon, between 0.5 and 10% by weight of calcium and/or strontium and/or barium, between 0 and 10% by weight of cerium and/or lanthanum, between 0 and 5% by weight of magnesium, less than 5% by weight of aluminium, between 0 and 10% by weight of manganese and/or titanium and/or zirconium and between 0.5 and 10% by weight of oxygen in the form of one or more metal oxides, the balance being iron, said inoculant being characterized in that it further comprises between 0.1 and 10% by weight of sulphur in the form of one or more metal sulphides.

According to a first embodiment, the inoculant is in the form of a solid mixture of a ferrosilicon based alloy, the metal oxide and the metal sulphide.

According to a second embodiment the inoculant is in the form of an agglomerated mixture of a ferrosilicon based alloy with the metal oxide and the metal sulphide.

The inoculant according to the present invention preferably comprises 0.5 to 5% by weight of manganese and/or titanium and/or zirconium.

According to a preferred embodiment the metal oxide is selected among FeO, $Fe_2O_3$, $Fe_3O_4$, $SiO_2$, MnO, MgO, CaO, $Al_2O_3$, $TiO_2$ and $CaSiO_3$, $CeO_2$, $ZrO_2$ and the metal sulphide is selected among FeS, FeS2, MnS, MgS, CaS and CuS.

The oxygen content of the inoculant is preferably between 1 and 6% by weight, and the sulphur content is preferably between 0.15 and 3% by weight.

It has surprisingly been found that the inoculant according to the present invention containing both oxygen and sulphur increases the number of nucleis formed when the inoculant is added to cast iron, thus obtaining an improved suppression of iron carbide formation using the same amount of inoculant as with conventional inoculants, or obtaining the same iron carbide suppression using less inoculant than when using conventional inoculants. It has further been found that when using the inoculant according to the present invention an improved reproducibility and thereby more consistent results are obtained.

According to a second aspect the present invention relates to a method for producing an inoculant for the manufacture of cast iron with lamellar, compacted or spheroidal graphite, providing a base alloy comprising 40 to 80% by weight of silicon, between 0.5 and 10% by weight of calcium and/or strontium and/or barium, between 0 and 10% by weight of cerium and/or lanthanum, between 0 and 5% by weight of magnesium, less than 5% by weight of aluminium, between 0 and 10% by weight of manganese and/or titanium and/or zirconium, adding 0.5 to 10% by weight of oxygen in the form of one or more metal oxides, characterized in that it is further added 0.1 to 10% sulphur in the form of one or more metal sulphides to the base alloy.

According to one embodiment of the method the metal oxide and metal sulphide are mixed with the base alloy by mechanically mixing of solid base alloy particles and solid metal oxide and metal sulphide particles. The mechanical mixing can be carried out in any conventional mixing apparatus which gives a substantially homogeneous mixing, such as for example a rotating drum.

According to another embodiment of the method the metal oxides and sulphides are pre-mixed followed by agglomeration using a binder, preferably sodium silicate solution and a pressing roll unit. The agglomerates are subsequently crushed and screened to the required final product sizing. Agglomeration of the powder mixtures will ensure that segregation of the added metal oxide and metal sulphide powders are eliminated.

EXAMPLE 1

Production of inoculant.

Batches of 10,000 grams of 75% ferrosilicon inoculants having a particle size between 0.5 and 2 mm and containing about 1% by weight of calcium, 1% by weight of cerium and 1% by weight of magnesium where mechanically mixed with different amounts of powderous iron oxide and iron sulphide materials as shown in table 1. The mixing was carried out using a rotating high speed drum mixer to obtain homogeneous mixtures of the different inoculants. The analytical oxygen and sulphur content of the five produced inoculants A through E is also shown in table 1. As can be seen from Table 1 inoculant A has no addition of oxygen or sulphur. Inoculant B has addition of sulphur only. Inoculants C and D have addition of oxygen only and inoculant E which is according to the present invention, has addition of both oxygen and sulphur.

TABLE 1

Mixtures of inoculant powder with sulphide and oxide.

| Test mixture No. | Sulphide Addition Type of Sulphide | Weight Added (g) FeS | Analytical Sulphur (g) | Oxide Addition Type of Oxide | Weight Added (g) | Analytical Oxygen (%) |
|---|---|---|---|---|---|---|
| A | FeS | — | — | $Fe_3O_4$ | — | — |
| B | FeS | 50 | 0.18 | $Fe_3O_4$ | — | — |
| C | FeS | — | — | $Fe_3O_4$ | 400 | 1.03 |
| D | FeS | — | — | $Fe_3O_4$ | 800 | 1.95 |
| E | FeS | 50 | 0.19 | $Fe_3O_4$ | 400 | 1.10 |

EXAMPLE 2

Production of inoculant.

Batches of 10,000 grams of 65 to 75% ferrosilicon inoculants having a particle size between 0.2 and 1 mm and containing various elements according to Table 2 below were mechanically mixed with powderous iron oxide and iron sulphide materials. The mixing was carried out using a rotating high speed drum mixer to obtain homogeneous mixtures of the different inoculants. The amounts of sulphide and oxide powder mixed with the ferrosilicon base materials are also shown in Table 2. Three of the powder mixtures were also agglomerated with sodium silicate solution. After mixing of the powders, these were added about 3% sodium silicate solution and agglomerated in a pressing unit followed by re-crushing to a final product sizing of 0.5–2 mm.

TABLE 2

Mixtures and agglomerated of inoculant powders.

| No. | FeSi—alloy | Sulphide addition FeS | Oxide addition $F_3O_4$ | Comment |
|---|---|---|---|---|
| F | 1.5% Ca | — | — | |
| G | 1.5% Ca | 50 g | 400 g | Agglomerated |
| H | 1.7% Ca, 1.5% Ce | 50 g | 400 g | Agglomerated |
| I | 1.7% Ca, 1.6% Ce, 1.3% Mg | 50 g | 400 g | Agglomerated |
| J | 1.1% Ca, 1.2% Ba | 50 g | 400 g | |
| K | 1.5% Ca, 4.7% Zr, 3.6% Mn | 50 g | 400 g | |

As can be seen from Table 2, inoculant F is according to the prior art while inoculants G through K are inoculants according to the present invention.

EXAMPLE 3

Application of inoculant.

The inoculant mixtures produced in Example 1 were tested in ductile iron to reveal how the sulphide and oxide mixtures affect the number of graphite nodules per $mm^2$ as a measure of inoculation performance. The number of graphite nodules formed is a measure of number of nucleis in the iron melt. Heats of liquid iron were treated with a conventional magnesium ferrosilicon alloy followed by addition of the inoculants A through F of Example 1 to the pouring ladle. Final iron composition was 3.7% C, 2.5% Si, 0.2% Mn, 0.04% Mg, 0.01% S.

Table 3 shows the resulting number of nodules in 5 mm section size sand moulded plates.

TABLE 3

Results from testing of inoculants in ductile cast iron.

| Test No. | Innoculant Alloy | % S | % O | Number of nodules (per mm$^2$) |
|---|---|---|---|---|
| A | Ca,Ce,Mg—FeSi | — | — | 469 |
| B | Ca,Ce,Mg—FeSi | 0.18 | — | 529 |
| C | Ca,Ce,Mg—FeSi | — | 1.03 | 493 |
| D | Ca,Ce,Mg—FeSi | — | 1.95 | 581 |
| E | Ca,Ce,Mg—FeSi | 0.19 | 1.10 | 641 |

As can be seen from the results in Table 1, inoculant E according to the present invention shows a very high number of nodules, about 50% higher than inoculant A which did not contain either oxygen or sulphur and also appreciable higher than inoculant B containing only sulphur and inoculants C and D containing only oxygen.

EXAMPLE 4

Application of inoculant.

The inoculant mixtures and agglomerates F through K produced in Example 2 were tested in ductile iron to reveal how the inoculant alloy composition affects final number of nodules formed as a measure of inoculation performance. Heats of liquid iron were treated with a conventional magnesium ferrosilicon alloy followed by addition of the inoculants F through K to the pouring ladle. Final iron composition was 3.7% C, 2.5% Si, 0.2% Mn, 0.04% Mg, 0.01% S. Table 4 shows the resulting number of nodules formed in 5 mm section size sand moulded plates. Some individual differences are obtained for the various alloy compositions, but inoculants G–K according to the present invention all perform substantially better than the sulphide and oxide free reference test F.

TABLE 4

Results from testing of inoculants in ductile cast iron.

| Test No. | Inoculant Alloy | Number of nodules (per mm$^2$) |
|---|---|---|
| F | Ca—FeSi | 399 |
| G | Ca—FeSi, S + O | 440 |
| H | Ca,Ce—FeSi, S + O | 436 |
| I | Ca,Ce,Mg—FeSi, S + O | 506 |
| J | Ca,Ba—FeSi, S + O | 478 |
| K | Ca,Zr,Mn—FeSi, S + O | 512 |

EXAMPLE 5

Application of inoculant.

More mixtures containing various FeSi-based inoculant alloys mixed with 0.5 wt % iron sulphide and 4 wt % iron oxide were tested in cast iron. Table 5 shows the composition of inoculants and results measured as number of nodules found in 25 mm diameter cylindrical test bars. The test inoculants L and M are sulphide and oxide free reference examples, while inoculants N and O are according to the present invention. The results show that inoculants N and O according to the present invention show excellent results compared to inoculants L and M according to the prior art.

TABLE 5

Results from testing of inoculants in ductile cast iron.

| Test no. | Inoculant Alloy | Number of nodules (per mm$^2$) |
|---|---|---|
| L | 1.5% Ca — FeSi | 178 |
| M | 1.5% Ca, 1.5% Ce—FeSi | 221 |
| N | 1.5% Ca, 1.5% Ce — FeSi, S + O | 259 |
| O | 1.5% Ca, 1.5% Ce, 1% Mg — FeSi, S + O | 338 |

EXAMPLE 6

Application of inoculant.

This example shows a comparison of an inoculant according to the present invention (inoculant R) with a commercial calcium/barium containing ferrosilicon inoculant (inoculant P) and another commercial ferrosilicon inoculant containing bismuth and rare earth metals (inoculant Q). Table 6 shows the results measured as number of nodules formed in 25 mm diameter cylindrical test bars.

Bismuth containing inoculants are generally recognized as those giving highest nodule count in ductile iron of all commercial alloys available. As shown in table 6, inoculant R according to the present invention produces an even higher number of nucleis than the bismuth alloy under the prevailing experimental conditions.

TABLE 6

Results from testing of inoculants in ductile cast iron.

| Test No. | Inoculant Alloy | Number of nodules (per mm$^2$) |
|---|---|---|
| P | 1% Ca, 1% Ba — FeSi | 174 |
| Q | 1.5% Ca, 1% Bi, 0.5% RE—FeSi | 508 |
| R | 1% Ca, 1% Ce, 1% Mg, 1% O, 0.2% S FeSi | 601 |

What is claimed is:

1. An inoculant for the manufacture of cast iron with lamellar, compacted or spheroidal graphite, said inoculant comprises:

between 40 and 80% by weight of silicon, between 0.5 and 10% by weight of one or more of calcium, strontium or barium, between 0 and 10% by weight of cerium and/or lanthanum, between 0 and 5% by weight of magnesium, less than 5% by weight of aluminium, between 0 and 10% by weight of one or more of manganese, titanium or zirconium, between 0.5 and 10% by weight of oxygen in the form of one or more metal oxides, between 0.1 and 10% by weight of sulphur in the form of one or more metal sulphides, and the balance being iron.

2. Inoculant according to claim 1, wherein said inoculant is in the form of a solid mixture of a ferrosilicon based alloy, the metal oxide and the metal sulphide.

3. Inoculant according to claim 2 wherein the metal oxide is selected from the group consisting of FeO, $Fe_2O_3$, $Fe_3O_4$, $SiO_2$, MnO, MgO, CaO, $Al_2O_3$, $TiO_2$ and $CaSiO_3$, $CeO_2$, $ZrO_2$ and the metal sulphide is selected from the group consisting of FeS, FeS2, MnS, MgS, CaS and CuS.

4. Inoculant according to claim 3, wherein the oxygen content is between 1 and 6% by weight and the sulphur content is between 0.1 and 3% by weight.

5. Inoculant according to claim 4 wherein the inoculant comprises between 0.5 and 5% by weight of one or more of manganese, titanium or zirconium.

6. Inoculant according to claim 1 wherein the metal oxide is selected from the group consisting of FeO, $Fe_2O_3$, $Fe_3O_4$, $SiO_2$, MnO, MgO, CaO, $Al_2O_3$, $TiO_2$ and $CaSiO_3$, $CeO_2$, $ZrO_2$ and the metal sulphide is selected from the group consisting of FeS, FeS2, MnS, MgS, CaS and CuS.

7. Inoculant according to claim 1 wherein the oxygen content is between 1 and 6% by weight and the sulphur content is between 0.1 and 3% by weight.

8. Inoculant according to claim 1 wherein the inoculant comprises between 0.5 and 5% by weight one or more of manganese, titanium or zirconium.

9. A method for producing an inoculant for the manufacture of cast iron with lamellar, compacted or spheroidal graphite, comprising:

providing a base alloy comprising 40 to 80% by weight of silicon, between 0.5 and 10% by weight of one or more of calcium, strontium or barium, between 0 and 10% by weight of cerium and/or lanthanum, between 0 and 5% by weight of magnesium, less than 5% by weight of aluminium, between 0 and 10% by weight of one or more of manganese, titanium or zirconium, the balance being iron, and adding to said base alloy 0.5 to 10% by weight of oxygen in the form of one or more metal oxides, and between 0.1 to 10% sulphur in the form of one or more metal sulphides to produce said inoculant.

10. Method according to claim 9, wherein the metal oxides and metal sulphides are mixed with the base alloy by mechanical mixing of solid base alloy particles, solid metal oxide particles, and solid metal sulphide particles.

11. Method according to claim 9, wherein the metal oxides and metal sulphides are mixed with the base alloy by mechanical mixing followed by agglomeration of the mixture by pressing with a binder material in a pressing roll unit.

* * * * *